US008286449B2

(12) United States Patent
Bosken, Jr. et al.

(10) Patent No.: US 8,286,449 B2
(45) Date of Patent: Oct. 16, 2012

(54) NECK RING AND METHOD OF MAKING FOR A GLASS CONTAINER FORMING MACHINE

(75) Inventors: William E. Bosken, Jr., Monclova, OH (US); Mark P. Dodd, Sylvania, OH (US); Ronald T. Myers, Whitehouse, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 797 days.

(21) Appl. No.: 11/986,693

(22) Filed: Nov. 26, 2007

(65) Prior Publication Data

US 2009/0134115 A1 May 28, 2009

(51) Int. Cl.
*C03B 9/347* (2006.01)

(52) U.S. Cl. ..... 65/274; 65/172; 65/235; 65/261; 65/260; 65/361; 65/374.1; 65/374.12; 65/374.15; 215/42

(58) Field of Classification Search ..... 65/374.15, 65/207, 229, 170, 225, 172; 419/8; 215/40, 215/42

See application file for complete search history.

(56) References Cited

U.S. PATENT DOCUMENTS

| | | | | |
|---|---|---|---|---|
| 2,987,854 | A * | 6/1961 | Payne | 65/80 |
| 3,186,818 | A | 6/1965 | Havens et al. | |
| 3,254,981 | A * | 6/1966 | Havens | 65/359 |
| 3,424,569 | A * | 1/1969 | Huebner | 65/172 |
| 3,776,711 | A * | 12/1973 | Hollingsworth | 65/261 |
| 3,785,795 | A * | 1/1974 | Colchagoff | 65/307 |
| 4,436,543 | A * | 3/1984 | Kasten | 65/172 |
| 5,609,664 | A * | 3/1997 | Olson | 65/361 |
| 5,725,629 | A * | 3/1998 | Olson | 65/361 |
| 5,769,920 | A * | 6/1998 | Sweetland et al. | 65/374.15 |
| 6,840,062 | B1 * | 1/2005 | Dakan et al. | 65/374.1 |
| 7,353,667 | B2 * | 4/2008 | Flynn | 65/235 |
| 7,472,565 | B1 * | 1/2009 | Heldoorn | 65/260 |
| 2005/0252244 | A1 * | 11/2005 | Heldoorn | 65/260 |
| 2009/0092512 | A1 * | 4/2009 | Heldoorn | 419/8 |
| 2009/0249835 | A1 * | 10/2009 | Flynn et al. | 65/172 |

FOREIGN PATENT DOCUMENTS

GB 2106094 A 4/1983

* cited by examiner

*Primary Examiner* — Anthony Stashick
*Assistant Examiner* — Cynthia Collado

(57) ABSTRACT

A neck ring for a glass container forming machine includes two neck ring sections each consisting essentially of a neck ring body and an insert on the body. The inserts have opposed surfaces for forming closure attachment features on a container neck finish molded in the neck ring. Each neck ring body is of die-formed powder metal construction and is set around the associated insert. The inserts preferably form the entire glass-contacting portion of the neck ring. The neck ring bodies preferably are of sintered bronze or steel construction, and the inserts preferably are of nickel, bronze or steel construction. The body and insert preferably are sintered together for a metallurgical bond.

22 Claims, 2 Drawing Sheets

NECK RING AND METHOD OF MAKING FOR A GLASS CONTAINER FORMING MACHINE

The present disclosure relates to a neck ring for a glass container forming machine, and to a method of making such a neck ring.

BACKGROUND AND SUMMARY OF THE DISCLOSURE

In glass container forming machines, the containers typically are formed in two stages. At a first or blank mold stage, a charge or gob of molten glass is formed into a parison or preform in a blank mold. A neck ring is positioned adjacent to the blank mold, and the container neck finish is formed against the neck ring to final size and geometry. The parison then is transferred by means of the neck ring to a blow mold, in which the container body is formed to final size and geometry. The neck ring typically includes two neck ring bodies that are of cast bronze or cast iron construction. It has been proposed to employ inserts assembled to precast neck ring bodies to obtain desired wear and heat transfer properties in the portions of the neck ring that contact the molten glass and form the container neck finish.

The present disclosure embodies a number of aspects that can be implemented separately from or in combination with each other.

A neck ring for a glass container forming machine, in accordance with one aspect of the present disclosure, includes two neck ring sections each consisting essentially of a neck ring body and an insert on the body. The inserts have opposed surfaces for forming closure attachment features on a container neck finish molded in the neck ring. Each neck ring body is of die-formed powder metal construction and is molded or otherwise set around the associated insert. The inserts preferably form the entire glass-contacting portion of the neck ring. The neck ring bodies preferably are of bronze or steel construction, and the inserts preferably are of nickel, bronze or steel construction. The body and insert preferably are sintered together for a metallurgical bond.

A method of making a neck ring for a glass container forming machine, in accordance with another aspect of the present disclosure, includes the step of near-net-shape forming a pair of neck ring bodies of powder metal construction, preferably bronze or steel construction. A pair of inserts of a powder metal different from the neck ring bodies, such as nickel, bronze or steel can be molded into the neck ring bodies to form the glass-contacting surfaces of the neck ring. Each body and associated insert preferably are sintered together to form a metallurgical bond.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
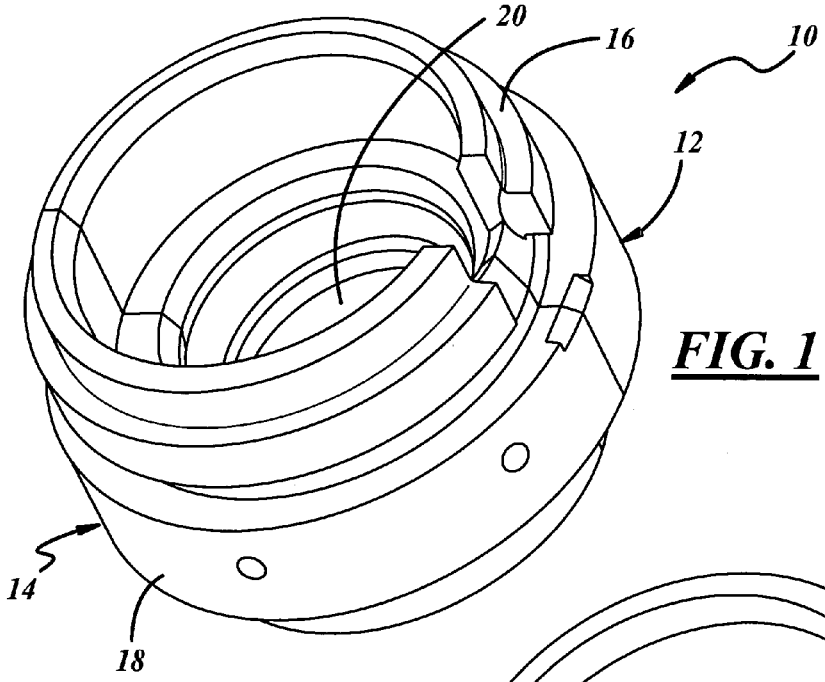
FIG. 1 is a perspective view of a neck ring in accordance with an exemplary embodiment of the present disclosure.
Figure 2:
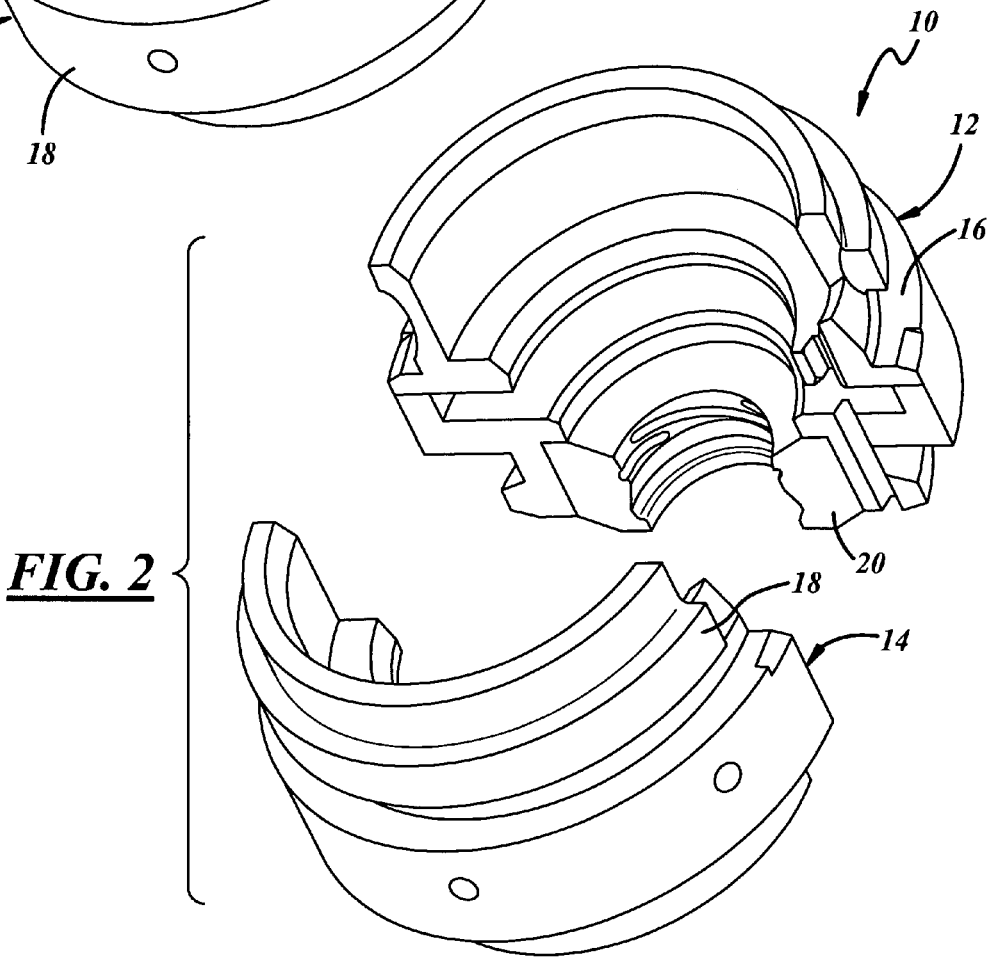
FIG. 2 is an exploded perspective view of the neck ring in the embodiment of FIG. 1.

The drawings illustrate an annular neck ring 10 for a glass container forming machine as including two semi-annular neck ring sections 12,14. FIG. 1 illustrates sections 12 and 14 in abutment for forming a container neck finish and transporting the container parison from the blank mold station to the blow mold station as previously described, while FIG. 2 illustrates sections 12,14 separated from each other, such as to release the container neck finish at the blow mold station. Each neck ring sections 12,14 includes an associated semi-annular neck ring body 16,18. Neck ring bodies 16,18 preferably are of near-net-shape die-formed powder metal construction, such as bronze or steel construction.

Figure 3:
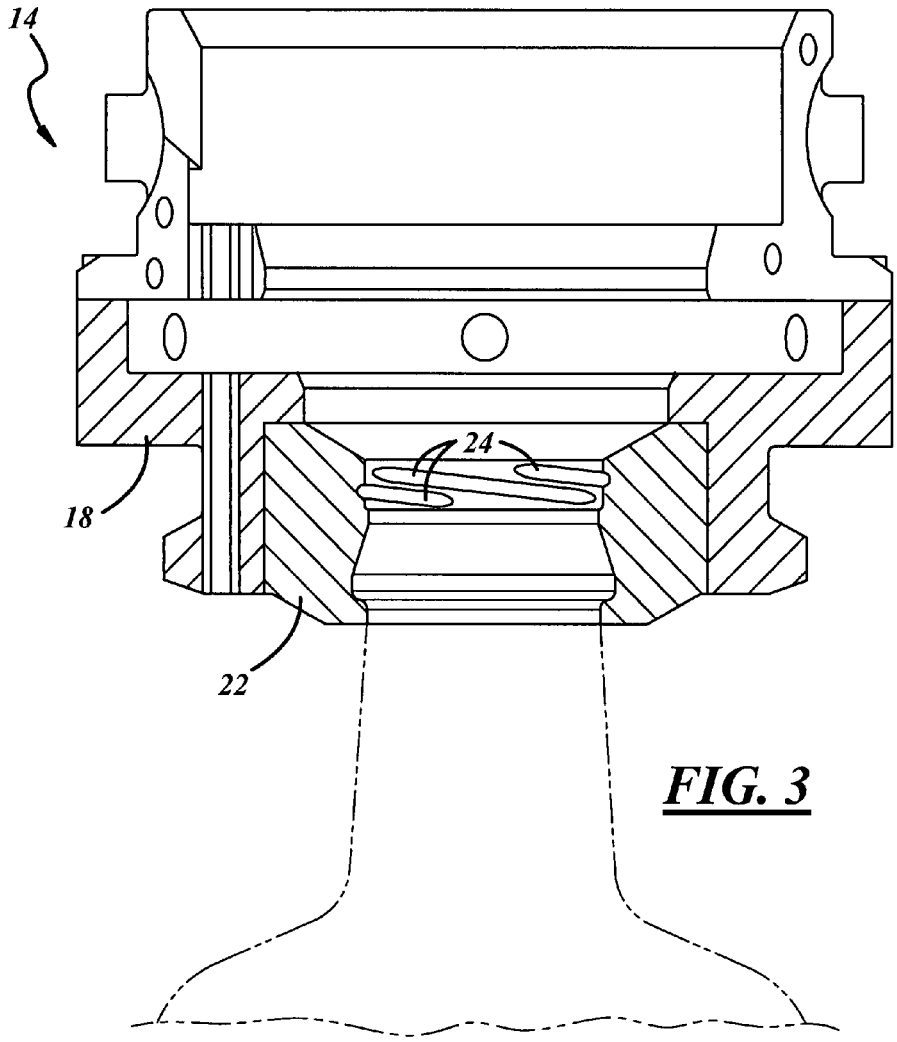
FIG. 3 is a schematic illustration of the neck ring in the embodiment of FIGS. 1 and 2 forming the neck finish of a glass container.
Figure 4:
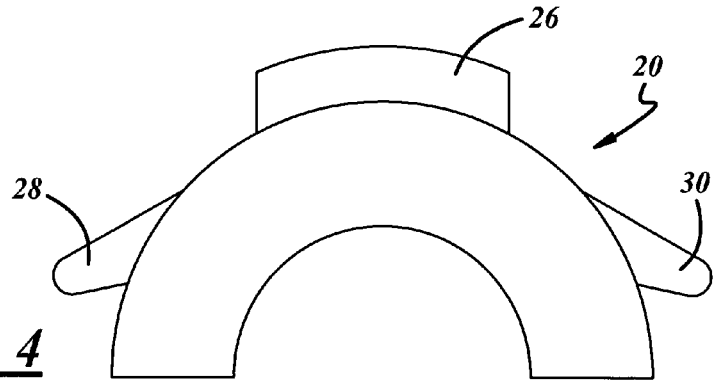
FIG. 4 is a plan view of a neck ring insert prior to being molded into the neck ring bodies in FIGS. 1-3.

Each neck ring sections 12,14 preferably includes an associated semi-annular insert 20, 22 (FIGS. 2-4). Inserts 20, 22 preferably are preformed and insert-molded into the associated die-formed powder metal body 16,18. Inserts 20, 22 have internal surfaces that form the closure attachment features on the final container neck finish, such as internal spiral recesses 24 (FIG. 3) for forming external thread segments on the container neck finish. Inserts 20,22 preferably form the entire glass-contacting surfaces of neck ring sections 12,14, which is to say that molten glass preferably does not contact any surface of neck ring bodies 16,18. Inserts 20,22 can be cast or machined of a suitable metal different from the metal of neck ring bodies 16,18, such as nickel, bronze or steel for example.

FIG. 4 illustrates neck ring insert 20, insert 22 being essentially identical to insert 20. Insert 20 has a plurality of angularly space outwardly extending tabs or ears 26, 28, 30 that become embedded in the neck ring body during insert molding firmly to hold the insert in place.

Use of powder metallurgy for forming neck ring bodies 16,18 provides significant cost savings over current technology, in which the neck ring bodies are of solid cast and machined construction. Furthermore, powder metals permit use of differing metals or metal alloys in the neck ring bodies and the inserts. After the inserts are molded into the neck ring bodies, each insert/body insert is sintered to form a strong metallurgical bond.

There thus have been disclosed a neck ring for a glass container forming machine and a method of making such a neck ring. The disclosure has been presented in conjunction with an exemplary embodiment, and various modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A neck ring for a glass container forming machine, which includes two neck ring sections each consisting essentially of a neck ring body and an insert on said body, said inserts being of powder metal construction and having opposed surfaces for forming closure attachment features on a container neck finish molded in said neck ring, wherein said neck ring bodies are of die-formed powder metal construction and are molded around said inserts such that said inserts are surrounded by said neck ring bodies, and wherein each insert and associated neck ring body are sintered together to form a metallurgical bond.

2. The neck ring set forth in claim 1 wherein said inserts have outwardly extending tabs embedded in said bodies.

3. A neck ring for a glass container forming machine that includes a pair of opposed neck ring bodies of die-formed sintered powder metal construction.

4. The neck ring set forth in claim 3 wherein each of said bodies is of sintered bronze or steel construction.

5. The neck ring set forth in claim 3 wherein each of said bodies includes an insert-molded insert of a metal different from said bodies and forming the entire glass-contacting surfaces of said neck ring.

6. The neck ring set forth in claim 5 wherein said insert is of powder metal construction and is sintered with said body to form a metallurgical bond between said body and said insert.

7. The neck ring set forth in claim 5 wherein each insert is of nickel or bronze construction.

8. The neck ring set forth in claim 5 wherein said inserts have outwardly extending tabs embedded in said bodies.

9. A neck ring for a glass container forming machine, which includes two neck ring sections each consisting essentially of a neck ring body and an insert on said body, said inserts having opposed surfaces for forming closure attachment features on a container neck finish molded in said neck ring, wherein said neck ring bodies are of die-formed sintered powder metal construction and are molded around said inserts such that said inserts are surrounded by said neck ring bodies.

10. The neck ring set forth in claim 9 wherein said inserts form the entire glass-contacting portions of said neck ring.

11. The neck ring set forth in claim 9 wherein each of said bodies is of bronze or steel construction.

12. The neck ring set forth in claim 11 wherein each of said inserts is of nickel, bronze or steel construction.

13. The neck ring set forth in claim 9 wherein said inserts have outwardly extending tabs embedded in said bodies.

14. The neck ring set forth in claim 13 wherein said inserts are of a construction selected from the group consisting of: (a) cast or machined metal construction, and (b) sintered powder metal construction.

15. A method of making a neck ring for a glass container forming machine, which includes the step of: (a) near-net-shape forming a pair of neck ring bodies of sintered powder metal construction.

16. The method set forth in claim 15 including the steps, prior to said step (a), of: (b) providing a pair of powder metal inserts of a metal different from said bodies, and (c) molding said inserts into said bodies during said step (a) such that said inserts form glass-contacting surfaces of said neck ring bodies.

17. The method set forth in claim 16 wherein each said body and associated insert are sintered after said step (c) to form a metallurgical bond between said inserts and said bodies.

18. The method set forth in claim 16 wherein said inserts have outwardly extending tabs that are embedded in said bodies during said step (c).

19. The method set forth in claim 15 including the steps, prior to said step (a), of: (b) providing a pair of inserts of a metal different from said bodies, and (c) molding said inserts into said bodies during said step (a) such that said inserts form glass-contacting surfaces of said neck ring bodies.

20. The method set forth in claim 19 wherein each of said bodies is of bronze or steel construction.

21. The method set forth in claim 20 wherein each of said inserts is of nickel, bronze or steel construction.

22. The method set forth in claim 19 wherein said inserts have outwardly extending tabs that are embedded in said bodies during said step (c).

* * * * *